United States Patent [19]

Verstraeten

[11] Patent Number: 4,655,301

[45] Date of Patent: Apr. 7, 1987

[54] EXPANSIBLE DRIVE CORE

[75] Inventor: Alexander J. Verstraeten, Knokkeheist, Belgium

[73] Assignee: Funderingstechnieken Verstraeten B.V., Netherlands

[21] Appl. No.: 797,890

[22] Filed: Nov. 14, 1985

[30] Foreign Application Priority Data

Nov. 21, 1984 [NL] Netherlands ..... 8403533

[51] Int. Cl.[4] ..... E21B 7/20

[52] U.S. Cl. ..... 175/171; 166/115; 166/187; 405/249

[58] Field of Search ..... 175/171, 19, 21, 259; 166/114, 115, 116, 187; 405/243, 245, 249; 299/21

[56] References Cited

U.S. PATENT DOCUMENTS

| | | | |
|---|---|---|---|
| 2,296,947 | 9/1942 | Pierce | 299/21 |
| 3,279,196 | 10/1966 | Dougherty | 405/245 |
| 3,289,761 | 12/1966 | Smith et al. | 166/187 |
| 3,327,483 | 6/1967 | Gibbons | 405/245 |
| 3,604,732 | 9/1971 | Malone | 166/187 |
| 3,620,026 | 11/1971 | Mallard | 405/249 |

*Primary Examiner*—Stephen J. Novosad
*Assistant Examiner*—William P. Neuder
*Attorney, Agent, or Firm*—Kane, Dalsimer, Kane, Sullivan and Kurucz

[57] ABSTRACT

The invention relates to an expansible drive core, which in its contracted state can be accommodated into a thin-walled tube, which has to be driven into the ground, wherein prior to the action of driving the drive core can be expanded as to be clamped against the inner side of the wall of the thin-walled tube, and after the action of driving the drive core can be contracted for removal from the tube.

According to the invention the drive core includes a metal core body and at least one expansion means of elastic material, such as rubber disposed over this core body, and passages are formed in the core body, through which a pressurized medium, such as air or water under pressure, can be supplied from the interior of the core body for expanding the elastic expansion means, while reinforcement means co-operate with the elastic expansion means so as to serve for the transmission of forces between the core body and the thin-walled tube.

32 Claims, 4 Drawing Figures

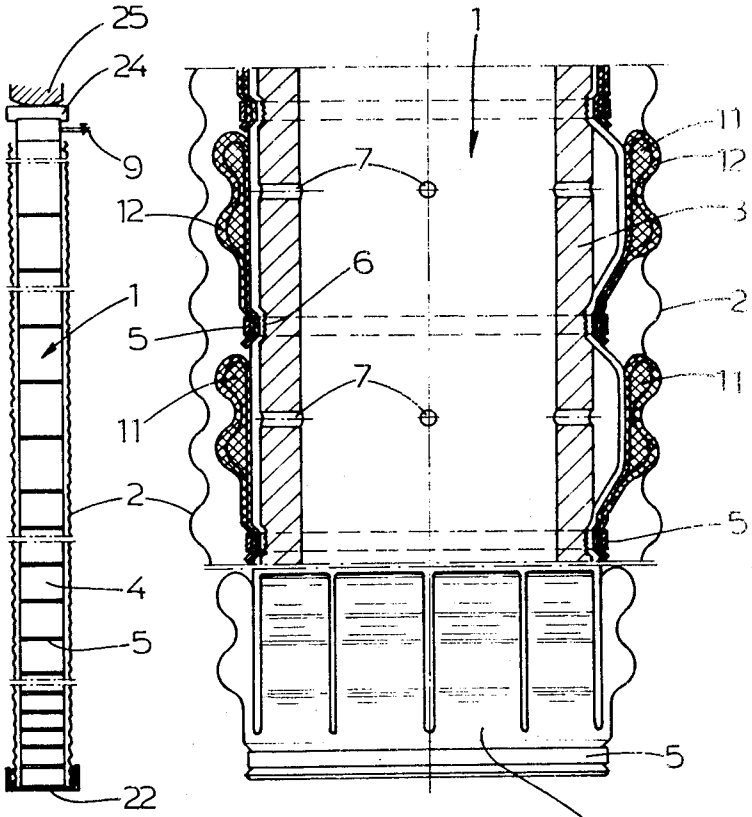
fig.1
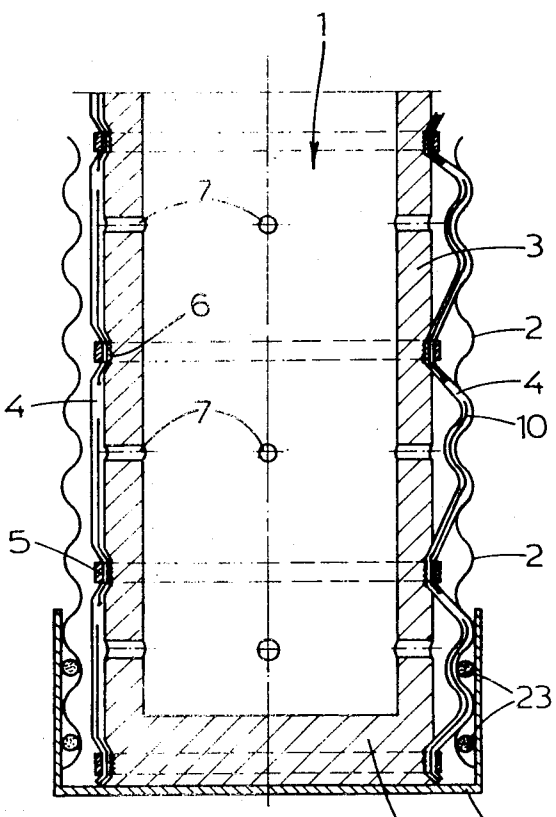
fig.2
fig.3

EXPANSIBLE DRIVE CORE

The invention relates to an expansible drive core which in its contracted state can be accommodated into a thin-walled tube which has to be driven into the ground, wherein prior to the action of driving the drive core can be expanded so as to be clamped against the inner side of the wall of the thin-walled tube, and after the action of driving the drive core can be contracted for removal from the tube.

Expansible drive cores of this kind are known in different embodiments.

In these known drive cores the expansion takes place because they are divided lenghtwise and are composed of drive core parts, which can be pressed outwardly from each other, or because they are provided with carrier means, which can be displaced outwardly.

Because very big acceleration forces appear during the action of driving the rigid drive core parts, or the rigid carrier means, respectively, which effectuate the connection with the thin-walled tube are often damaged after a short time. In this connection the known expansible drive cores often necessitate expensive repair work and these drive cores only have a rather limited lifetime.

It is an object of the present invention to provide a drive core, in which the disadvantages mentioned are removed in an efficient way.

For this purpose the drive core according to the invention is characterized in that the drive core includes a metal core body and at least one expansion means of elastic material, such a rubber disposed over this core body, and passages are formed in the core body, through which a pressurized medium, such as air or water under pressure, can be supplied from the interior of the core body for expanding the elastic expansion means, whilst reinforcement means co-operate with the elastic expansion means so as to serve for the transmission of forces between the core body and the thin-walled tube.

The elastic expansion means of rubber or such material together with the reinforcement means co-operating therewith is (are) capable of transmitting the acceleration forces generated during the action of driving to the thin-walled tube without causing damages thereto.

A favourable embodiment of the drive core according to the invention is characterized in that the elastic expansion means consists of an elastic sleeve surrounding the core body, the elastic sleeve being connected circumferentially to the core body at positions spaced above each other, wherein the passages in the core body lie between successive connecting positions to supply the pressurized medium between the exterior of the core body and the interior of the elastic sleeve.

Each sleeve portion lying between successive connecting positions carries the adjacent portion of the thin-walled tube along with it when it is being driven into the ground and overcomes the friction forces exerted by the ground on this tube portion.

The reinforcement means can be locally accommodated in the elastic sleeve and can be formed in such a way that they allow the expansion of the elastic sleeve between successive connecting positions.

The reinforcement means, which allow an expansion of the elastic sleeve in radial direction prevent an elastic deformation of the sleeve in axial direction. Because a high friction coefficient and practically no slip appear between the elastic sleeve of rubber or the like and the thin-walled tube generally made of metal, the action of driving the thin-walled tube into the ground takes place with minimal energy losses.

The reinforcement means can consist of metal reinforcement strips or wires accommodated in the elastic sleeve and extending in the longitudinal direction of this sleeve.

Alternatively, the reinforcement means can consist of fibres, such as synthetic fibres, accommodated in the elastic sleeve and extending in the longitudinal direction of this sleeve.

As a further alternative it is possible that the reinforcement means are disposed externally of the elastic sleeve and are locally connected to this sleeve.

Preferably the elastic sleeve is clamped onto the core body at the connecting positions by means of circumferentially extending clamping strips of metal or such material.

As an alternative for the embodiment of the elastic expansion means as an elastic sleeve it is proposed according to a very important embodiment of the expansible drive core according to the invention that a number of elastic expansion means are used, which consist of elastic tubes spaced above each other around the core body.

Herein each elastic tube can be connected to a supply line for the pressurized medium, which is mounted in one of the passages in the core body.

In this embodiment the reinforcement means will generally be provided externally of the elastic tubes.

The invention will hereafter be elucidated with reference to the drawings which show some embodiments of the expansible drive core according to the invention by way of example.

FIG. 1 is a very schematical longitudinal section of an embodiment of an expansible drive core according to the invention.

FIG. 2 is a longitudinal section of the lower portion of the drive core of FIG. 1 shown on a bigger scale, wherein the drive core is contracted at its left half and is expanded at its right half.

FIG. 3 is partially a longitudinal view and partially a side view of a portion of a modified embodiment of the drive core according to the invention, wherein the drive core is contracted at its left half and is expanded at its right half.

Figure 4:
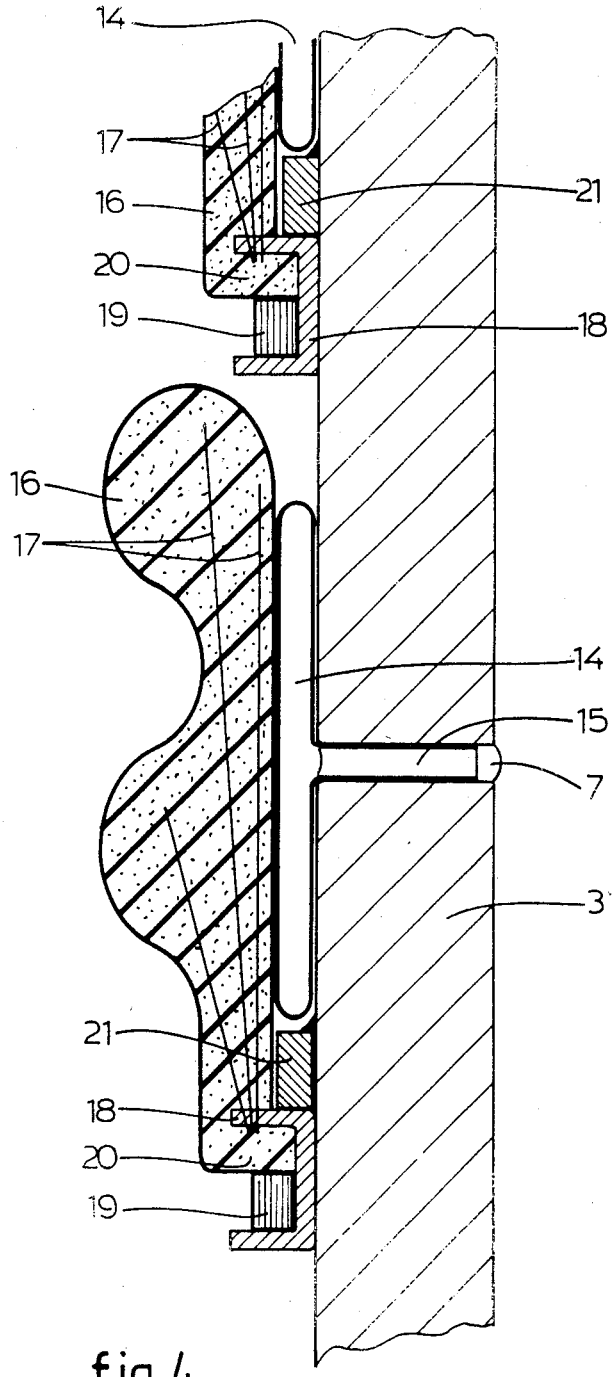
FIG. 4 shows half of a longitudinal section of a portion of still another embodiment of the drive core according to the invention.

FIGS. 1 and 2 show a first embodiment of an expansible drive core 1, which can be used for driving a thin-walled tube 2 (often called "casing") into the ground. In the drawings this thin-walled tube 2 is corrugated for reasons of stabilisation, which is, however, not necesarry. As a consequence of its small wall thickness the tube 2 per se is not capable to withstand the drive pulses, which appear during the operation of driving it into the ground.

The expansible drive core 1 is brought into the thin-walled tube 2 in its contracted state, whereafter the drive core 1 is clamped against the inner side of the wall of the thin-walled tube 2 by being expanded prior to driving, whereupon the drive strokes are transmitted from the drive core 1 to the thin-walled tube 2. After the thin-walled tube 2 is brought to the desired depth, the drive core 1 is contracted again and thereupon removed from the thin-walled tube 2.

The drive core 1 consists of a clindrical metal core body 3 and a sleeve 4 of elastic material, such as rubber, which surrounds this core body 3. This elastic sleeve 4 is circumferentially connected with the core body 3 at positions spaced above each other, for which in the embodiments shown by way of example the elastic sleeve 4 is clamped at the connecting places on the core body 3 by means of circumferential clamping straps 5 from metal or such material.

In order to improve the connection between the core body 3 and the elastic sleeve 4 under the clamping straps 5 grooves 6 are formed in the core body 3 at the position of the clamping straps 5, the grooves 6 having a fluted bottom. Hereby a rigid fixation of the elastic sleeve 4 to the core body 3 is guaranteed. However, additionally, the elastic sleeve 4 can adhesively be bonded into the grooves 6 in the core body 3, if desired.

Between adjacent connecting positions passages 7 are provided in the core body 3, through which a pressurized medium, such as air or water under pressure, can be supplied between the exterior of the core body 3 and the interior of the elastic sleeve 4, in order to expand this sleeve 4.

At its lower side the drive core 1 is closed by a bottom wall 8, while near its upper end a supply line 9 for the pressurized medium communicates with the interior of the core body 3.

Reinforcement means co-operate with the elastic sleeve 4, the reinforcement means having practically no stretch in their longitudinal direction and serving for the transmission of forces between the core body 3 and the thin-walled tube 2. These reinforcement means are formed such, that they allow the radial expansion of the elastic sleeve 4 between adjacent clamping straps 5, but prevent an elastic deformation of this sleeve 4 in the axial direction.

In the embodiment according to FIG. 2 the reinforcement means are locally accommodated in the elastic sleeve 4 and consist of fibres 10, such as synthetic fibres 10 extending in the longitudinal direction of this sleeve 4. As an alternative, reinforcement means accommodated locally in the elastic sleeve 4 can consist of metal reinforcement strips or wires extending in the longitudinal direction of the sleeve. The elastic sleeve 4 can be provided with external profile ribs extending in the longitudinal or circumferential direction.

In FIG. 3 still another embodiment of the reinforcement means is shown. These reinforcement means are provided externally of the elastic sleeve 4 and are locally connected to the elastic sleeve 4.

The reinforcement means of FIG. 2 as well as the reinforcement means of FIG. 3 extend to pass under a clamping strap 5 and extend upwardly from this clamping strap 5, while they end under the next clamping strap 5.

When a corrugated thin-walled tube 2 is used, as illustrated in the drawings, the reinforcement means of FIGS. 2 and 3 have such a height that they extend at least along one wave length of this thin-walled tube 2.

When the reinforcement means consist of metal strips accommodated in the elastic sleeve 4, it can be avantageous if each set of metal strips spaced about the circumference at the same level in the elastic sleeve 4 is connected at the lower side to a circumferentially extending metal connecting ring, which is integrally formed with the strips and which extends in the sleeve 4 at the height of the respective clamping strap 5 for the connection of the core body 3 to the elastic sleeve 4.

In the embodiment according to FIG. 3 the external reinforcement means comprise elastic flaps 11 of rubber or such material internally provided with an armouring 12. This armouring 12 can be formed from metal wires or strips, or from fibres such as synthetic fibres.

In the embodiment according to FIG. 3 each set, for instance 6–8, of elastic flaps 11 provided at the same height around the circumference of the elastic sleeve 4 are connected at the lower side to a circumferentially extending connecting ring 13 integrally formed with these flaps 11, the connecting ring 13 extending to pass under a clamping strap 5 and being clamped by this clamping strap 5 onto the elastic sleeve 4.

The elastic flaps 11 have a corrugated configuration at the outer side, which is adapted to the corrugated configuration of the thin-walled tube 2. Furthermore the armouring 12 in the elastic flaps 11 comprises a corrugated portion, which is also adapted to the corrugated configuration of the thin-walled tube 2.

Because on the lower portion of the thin-walled tube 2, by which that portion is understood, which extends from the lower end of the tube 2 to a height of approximately 8–10 times the diameter of this tube 2, the greatest friction forces are exerted, which for instance can amount to 2,5–3 kg/cm$^2$ when the tube 2 is being driven into the ground, the pressing force of the drive core 1 against the thin-walled tube 2 should preferably be at its maximum in this lower portion. The portion of the thin-walled tube 2 lying thereabove meets substantially less friction of the ground during the driving action because of the occurring lubricating effect.

In connection thereto, first of all, the distance between the successive clamping straps 5 is smaller in the lower portion of the drive core 1 than in the upper portion of the drive core 1, which is particularly illustrated in FIG. 1. It is, for instance, possible to position the clamping straps 5 at a distance of about 10 cm from each other from the lower end of the drive core 1 to a height of 8–10 times the diameter of the drive core 1, while this distance can be about 20 cm in the portion of the drive core lying thereabove and can amount to about 40 cm in the upper portion of the drive core 1.

Further, the passages 7 in the lower portion of the drive core 1 have a greater diameter and/or these passages 7 are provided in a greater number than in the upper portion of the drive core 1.

In this way it is obtained that when a medium is being supplied through the passages 7, the expansion of the elastic sleeve 4 starts at the lower side of the drive core 1 and moves upwardly.

FIG. 4 shows a very important modified embodiment of the expansible drive core according to the invention. In this embodiment a number of elastic expansion means are used, which consist of elastic tubes 14 provided around the core body at distances above each other.

Each elastic tube is connected to a supply line 15 for the pressurized medium, which is fixed, for instance by means of adhesively bonding, in one of the passages 7 in the core body 3.

In this embodiment the reinforcement means are provided externally of the elastic tubes 14 and consist of elastic flaps 16 made of rubber or such material and having an armouring 17. This armouring 17 can consist of metal strips or wires, or of fibres such as synthetic fibres.

Around the circumference of each elastic tube 14 generally a set of elastic flaps 16 is provided, the armouring 17 thereof being connected to a metal mounting ring 18, which is fixed to the core body 3, for instance by means of a clamping strap 19.

Each set of elastic flaps 16 is connected at the lower side to a circumferentially extending ring 20 formed integrally with these flaps 16, while the connecting ring 20 engages the mounting ring 18.

In the embodiment shown by way of example the mounting ring 18 consists of a U-section, wherein the upper leg thereof, which extends outwardly, is accommodated in the connecting ring 20 of the respective set of elastic flaps 16 and is connected to the armouring 17 of the respective set of elastic flaps 16.

Directly above each mounting ring 18 a metal stop ring 21 is provided on the core body 3, for instance by means of a welded joint, so that the drive pulses are transmitted through the mounting ring 18 to the elastic flaps 16 with the armouring 17.

Through the expansion of the elastic tubes 14 the elastic flaps 16 are brought into a force transmitting contact with the thin-walled tube 2 in the same way as in the embodiment of FIG. 3.

As appears from FIGS. 1 and 2, underneath the drive core 1 a lost cap 22 is provided, which surrounds the lower portion of the thin-walled tube 2 and which is sealed with respect to the thin-walled tube 2 by means of O-rings 23. This cap 22 can be subjected to small displacements in the axial direction with respect to the thin-walled tube 2 under influence of the drive pulses.

In case a thin-walled tube 2 has to be urged into the ground, first of all, a drive core 1 is brought into the thin-walled tube 2. When the drive core 1 is being brought into the thin-walled tube 2, it is possible to generate a vacuum in the core body 3 through the line 9, so that the elastic sleeve 4 (FIGS. 1–3) or the elastic tubes 14 (FIG. 4) are being sucked tightly against the core body 3 through the passages 7.

After the drive core 1 has obtained its proper end position in the thin-walled tube 2 and has come to rest on the cap 22, the supply of the pressurized medium to the interior of the core body 3 is started, whereupon this pressurized medium expands the elastic sleeve 4, or the elastic tubes 14, respectively, in such way that in the embodiment of FIG. 2 this sleeve 4 itself comes into force-transmitting contact with the thin-walled tube 2, while in the embodiments of FIGS. 3 and 4 as a consequence of the expansion of the elastic sleeve 4, or the elastic tubes 14, respectively, the elastic flaps 11 provided with the armouring 12 or the elastic flaps 16 provided with the armouring 17 are brought into force-transmitting contact with the thin-walled tube 2.

On the drive core 1 a pile cover 24 is resting, which subjects the drive strokes of a driving ram 25, whereby the drive core 1 is driven into the ground together with the thin-walled tube 2. After the thin-walled tube 2 in this way is brought to depth, the pressurized medium is discharged through the line 9, while a vacuum can be generated again in the core body 3, if desired, whereupon the drive core 1 is removed from the thin-walled tube 2, which remains in the ground together with the cap 22 and which serves for forming a foundation pile or the like in the ground.

The invention is not restricted to the embodiments shown in the drawings by way of example, which can be varied in several ways within the scope of the invention.

I claim:

1. An expansible drive core, which in its contracted state can be accommodated into a thin-walled tube which is to be driven into the ground wherein, prior to the action of driving, the drive core can be expanded so as to be clamped against the inner side of the wall of the thin-walled tube, and after the action of driving the drive core can be contracted for removal from the tube, wherein the drive core comprises:

a metal core body;

an expansion means consisting of an elastic sleeve surrounding the core body, the elastic sleeve being connected circumferentially to the core body at positions spaced above each other;

passages formed in the core body and lying between successive connecting positions of the elastic sleeve, the passages being adapted to supply a pressurized medium from the interior of the core body to spaces between the exterior of the core body and the interior of the elastic sleeve so as to expand the elastic sleeve between its connecting positions; and reinforcement means serving for the transmission of forces between the core body and the thin-walled tube and consisting of elastic flaps which are disposed externally of the elastic sleeve and are locally connected to the elastic sleeve, the elastic flaps being internally provided with an armouring.

2. A drive core as claimed in claim 1, wherein the reinforcement means are locally accommodated in the elastic sleeve and are formed in such a way that they allow the expansion of the elastic sleeve between successive connecting positions.

3. A drive core as claimed in claim 2, wherein the reinforcement means consist of metal reinforcement strips or wires accommodated in the elastic sleeve and extending in the longitudinal direction of this sleeve.

4. A drive core as claimed in claim 2, wherein the reinforcement means consist of fibres, such as synethetic fibres accommodated in the elastic sleeve and extending in the longitudinal direction.

5. A drive core as claimed in claim 1, wherein the elastic sleeve is clamped onto the core body at the connecting positions by means of circumferentially clamping straps of metal or such material.

6. A drive core as claimed in claim 1, wherein the reinforcement means extend upwardly from a connecting position of the core body to the sleeve and end under the next connecting position.

7. A drive core as claimed in claim 6, wherein the reinforcement means extend to pass under the respective connecting position of the core body to the sleeve.

8. A drive core as claimed in claim 1, wherein the thin-walled tube is corrugated, and in the expanded condition of the elastic sleeve the reinforcement means extend along at least one wave length of the thin-walled tube.

9. A drive core as claimed in claim 3, wherein a set of metal strips disposed in the elastic sleeve at the same height and spaced about the circumference extends upwardly from a connecting position of the core body to the sleeve and ends under the next connecting position, whilst the set of metal strips is connected at the lower side to a circumferentially extending connecting ring, which extends at the respective connecting position of the core body to the elastic sleeve.

10. A drive core as claimed in claim 5, wherein the external reinforcement means extend to pass under a clamping strap and are clamped onto the elastic sleeve by means of this clamping strap.

11. A drive core as claimed in claim 1, wherein the armouring is made of metal.

12. A drive core as claimed in claim 1, wherein the armouring is made of fibres, such as synthetic fibres.

13. A drive core as claimed in claim 1, wherein the thin-walled tube is corrugated, and the elastic flaps have a corrugated configuration at the outer side, which is adapted to the corrugated configuration of the thin-walled tube.

14. A drive core as claimed in claim 13, wherein the armouring in the elastic flaps have a corrugated portion, which is adapted to the corrugated configuration of the thin-walled tube.

15. A drive core as claimed in claim 10, wherein a set of external reinforcement means disposed at the same height around the circumference of the elastic sleeve is connected at the lower side to a circumferentially extending connecting ring integrally formed with the external reinforcement means, wherein this connecting ring is clamped onto the elastic sleeve by means of the respective clamping strap.

16. A drive core as claimed in claim 1, wherein the elastic sleeve is provided with longitudinally or circumferentially extending profile ribs.

17. A drive core as claimed in claim 5, wherein the distance between the successive clamping straps is smaller in the lower portion of the drive core than in the upper portion of the drive core.

18. A drive core as claimed in claim 1, wherein the air supply passages in the lower portion of the drive core have a greater diameter and/or are provided in a greater number than in the upper portion of the drive core.

19. A drive core as claimed in claim 5, wherein grooves are formed in the core body at the location of the clamping straps.

20. A drive core as claimed in claim 19, wherein the bottom of the grooves is fluted.

21. A drive core as claimed in claim 19, wherein the elastic sleeve is adhesively bonded into the grooves in the core body.

22. An expansible drive core, which in its contracted state can be accommodated into a thin-walled tube which is to be driven into the ground wherein, prior to the action of driving, the drive core can be expanded so as to be clamped against the inner side of the wall of the thin-walled tube, and after the action of driving the drive core can be contracted for removal from the tube, wherein the drive core comprises:

a metal core body;

expansion means, consisting of a plurality of elastic tubes spaced above each other around the core body;

passages formed in the core body and each connecting the interior of the core body to the respective tube, the passages being adapted to supply a pressurized medium from the interior of the core body to the elastic tubes so as to expand the elastic tubes; and reinforcement means serving for the transmission of forces between the core body and the thin-walled tube ad consisting of elastic flaps which are disposed externally of the elastic tubes, the elastic flaps being internally provided with an armouring.

23. A drive core as claimed in claim 22, wherein each elastic tube is connected to a supply line for the pressurized medium, which is mounted in one of the passages in the core body.

24. A drive core as claimed in claim 22, wherein the armouring is made of metal.

25. A drive core as claimed in claim 22, wherein the armouring is made of fibres, such as synthetic fibres.

26. A drive core as claimed in claim 22, wherein a set of elastic flaps is disposed around the circumference of each elastic tube, the armouring thereof being connected to a metal mounting ring which is mounted on the core body.

27. A drive core as claimed in claim 26, wherein each set of elastic flaps is connected at the lower side to a circumferentially extending ring integrally formed with these flaps, the connecting ring engaging the mounting ring.

28. A drive core as claimed in claim 27, wherein each mounting ring is mounted on the core body by means of a clamping strap.

29. A drive core as claimed in claim 26, wherein directly above each mounting ring a metal stop ring is mounted on the core body, for instance by means of welding.

30. A drive core as claimed in claim 27, wherein the connecting ring consists of a section, an upper outwardly extending leg thereof being accommodated at least partially in the connecting ring of the respective set of elastic flaps and being connected to the armouring of the respective set of elastic flaps.

31. A drive core as claimed in claim 1, wherein the core body is closed in a sealing way at the lower side and is connected to a supply for the pressurized medium at the upper side.

32. A drive core as claimed in claim 31, wherein underneath the drive core a lost cap is provided, which surrounds the lower portion of the thin-walled tube in a sealing way.

* * * * *